United States Patent [19]

Hafner

[11] 3,981,064

[45] Sept. 21, 1976

[54] METHOD AND APPARATUS FOR INTERLOCKING OVERLAPPING SHEET MATERIAL

[76] Inventor: Otto P. Hafner, 1321 Paddock Way, Cherry Hill, N.J. 08034

[22] Filed: Oct. 16, 1975

[21] Appl. No.: 623,036

Related U.S. Application Data

[60] Continuation-in-part of Ser. No. 560,786, March 21, 1975, Pat. No. 3,934,327, which is a continuation-in-part of Ser. No. 497,884, Aug. 16, 1974, Pat. No. 3,885,299, which is a division of Ser. No. 384,494, Aug. 1, 1973, Pat. No. 3,862,485.

[52] U.S. Cl. ..... 29/432; 29/200 B; 29/521; 113/1 M; 113/116 FF

[51] Int. Cl.[2] ..... B23P 11/00

[58] Field of Search..... 29/432, 432.1, 432.2, 29/200 B, 200 R, 521, 208 D, 509, 522; 113/116 FF, 1 M; 403/282, 285

[56] References Cited

UNITED STATES PATENTS

| | | | |
|---|---|---|---|
| 2,254,558 | 9/1941 | Williams | 29/521 X |
| 2,671,361 | 3/1954 | Sandberg | 29/432 UX |
| 3,470,596 | 10/1969 | Belada | 29/521 X |
| 3,599,318 | 8/1971 | Behlen | 29/509 |
| 3,726,000 | 4/1973 | Hafner | 29/432 X |
| 3,791,016 | 2/1974 | Eberhardt et al. | 29/432 |

*Primary Examiner*—Victor A. DiPalma
*Attorney, Agent, or Firm*—Paul & Paul

[57] ABSTRACT

A punch and press mechanism is used to interlock two or more overlying sheets of metal, or other material having plasticity or deformable properties, by partially piercing and deforming minor areas of the sheets. The mechanism includes a pierce-and-forming punch, a hollow cylindrical die, and a flattening punch. The die cavity is aligned with, and cooperates with, the pierce-and-forming punch to displace minor areas of the sheets. The flattening punch is slidably movable within the central bore of the die. Adjustment means are included so that the position of the die relative to the flattening punch may be so adjusted that compressive force is applied to the upper displaced minor area at a time when the lower displaced minor area is not confined by the die, whereby the lower displaced minor area is spread while the upper minor area is still constrained. To reduce the extent to which the displaced minor areas project above the major areas of the sheets, the edge portions of the major areas adjacent the piercings or cuts may be bent downwardly. To reduce or eliminate the amount of light or liquid, such as water, which can pass through the interlocking joint, a small portion of the lower displaced minor area may be left in the slot formed by the piercings and displacements.

4 Claims, 12 Drawing Figures

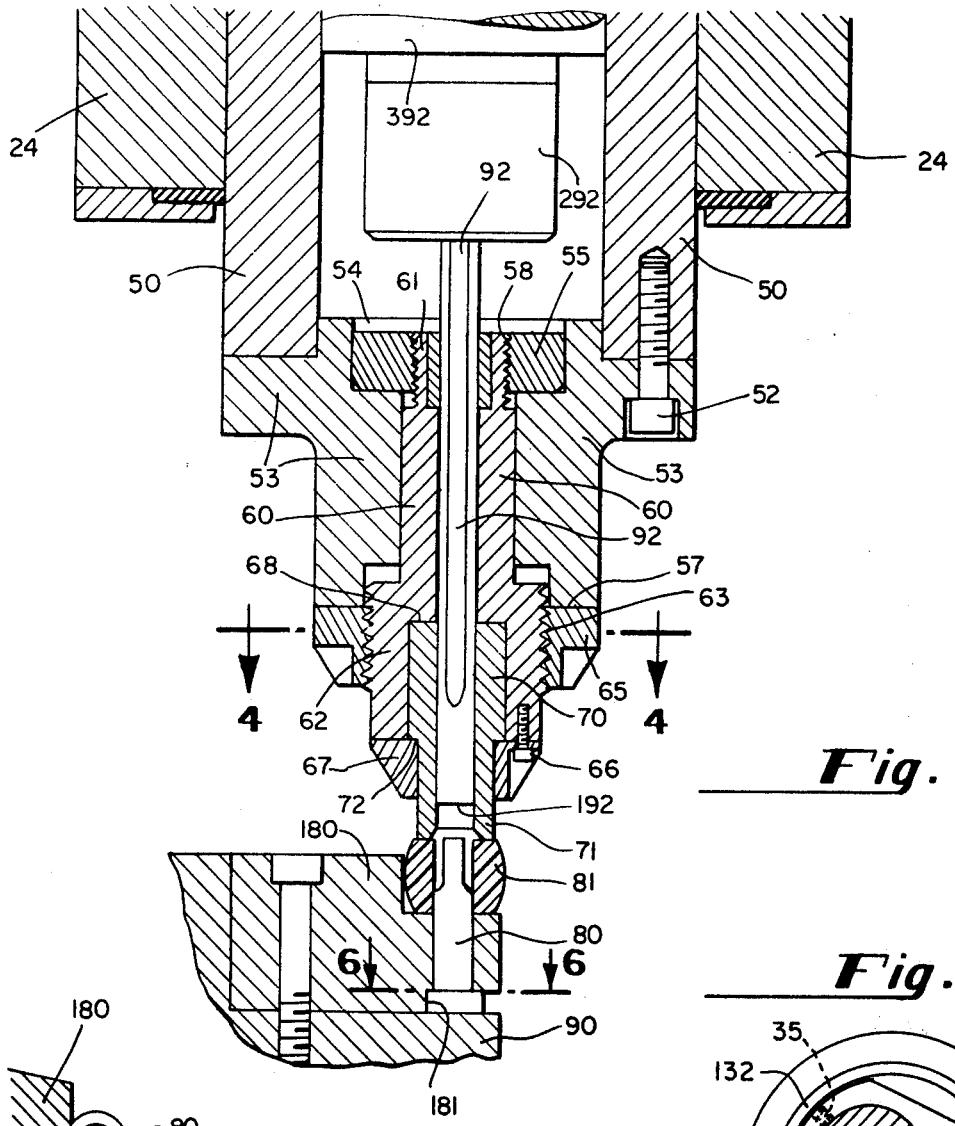
Fig. 3
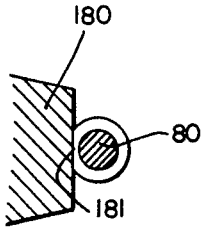
Fig. 6
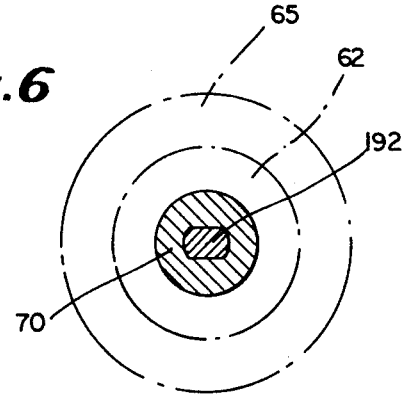
Fig. 4
Fig. 2
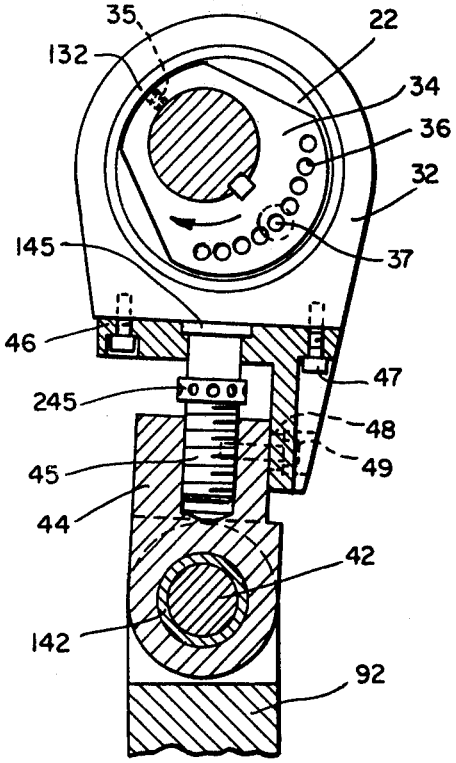

METHOD AND APPARATUS FOR INTERLOCKING OVERLAPPING SHEET MATERIAL

BACKGROUND OF THE INVENTION

This invention relates to a method of interlocking two or more overlying sheets of deformable metal or other material having the property of yielding or flowing under load and of sustaining appreciable permanent deformation without rupture. In some instances there may be an intervening layer of film of another material between the sheets to be fastened.

CROSS-REFERENCE TO RELATED APPLICATIONS

This application is a continuation-in-part application of my earlier-filed pending application, Ser. No. 560,786 filed Mar. 21, 1975 now U.S. Pat. No. 3,934,327, which was a continuation-in-part of my application Ser. No. 497,884 filed Aug. 16, 1974, now U.S. Pat. No. 3,885,299, which was a division of my application Ser. No. 384,494, filed Aug. 1, 1973 now U.S. Pat. No. 3,862,485.

SUMMARY OF THE INVENTION

An object of the present invention is to provide a method of and means for locking together overlying sheets of metal or other material having deformable properties by piercing the overlying sheets and displacing minor areas. To reduce the extent of the displacement, relative to the planes of the major areas of the overlying sheets, the edge portions of the major areas immediately adjacent the slots formed by the piercings and displacements may be bent in the opposite direction from the direction of displacement. To reduce or eliminate the amount of light or water which will pass through the interlocking joint, a small portion of the displaced minor area of the lower sheet is allowed to remain in the slot.

BRIEF DESCRIPTION OF THE DRAWINGS

FIG. 2 is a fragmentary view, largely in section, looking along the lines 2—2 of FIG. 1.

FIG. 3 is an enlarged fragmentary view, in section, of the lower portion of the structure shown in FIG. 1.

FIG. 4 is a view looking down along the line 4—4 of FIG. 3.

FIG. 6 is a view, in section, looking downwardly along the line 6—6 of FIG. 3.

DETAILED DESCRIPTION OF THE PREFERRED EMBODIMENTS

Figure 1:
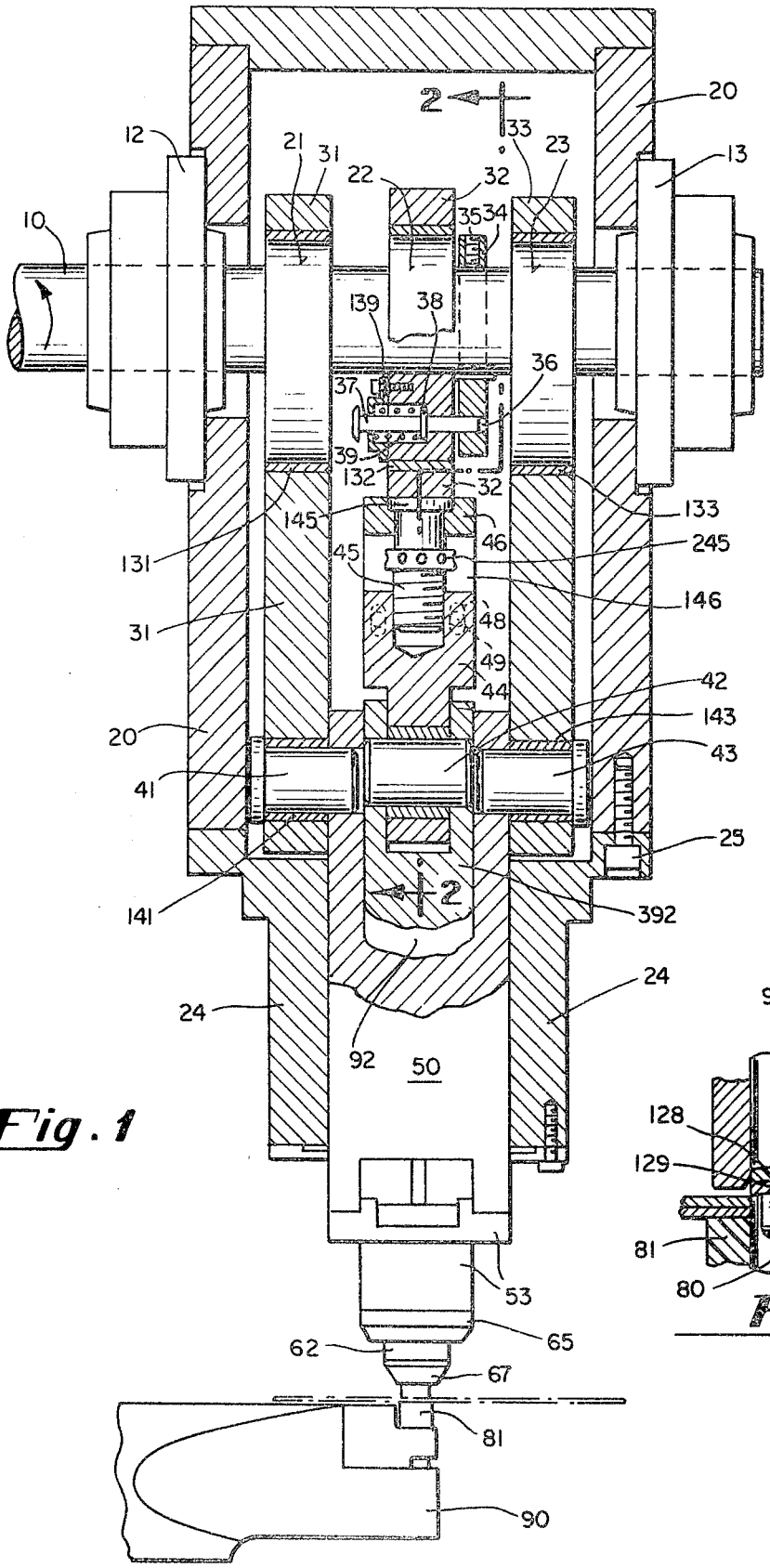
FIG. 1 is an elevational view, largely in section, of the head portion of one form of fastening machine suitable for use in carrying out the method of the present invention.

Referring now to FIG. 1, a crank shaft 10, which is driven rotationally by means not shown, has at its forward end a pair of spaced-apart sheet blocks 12 and 13 which are supported by a crank housing 20.

Supported on crank shaft 10, within the housing 20, are three eccentric discs 21, 22 and 23. The two outside discs 21 and 23 are keyed to the crank shaft. The holes of the two outside eccentric discs 21 and 23 are identically positioned and hence these two outside eccentrics move in timed coincidence with each other. The center eccentric 22 is supported free on shaft 10 and, by means to be described, is maintained in out-of-phase relation with the two outside eccentrics. This phase relationship is adjustable by a phase selector drive plate 34. In a typical case, for a particular metal thickness, the center eccentric may, for example, have a delay angle of the order of 37°.

As clearly seen in FIGS. 1 and 2, the angular position of the center eccentric disc 22 is determined and controlled by the phase selector drive plate 34 which is fixed to crank shaft 10, as by set screw 35 and key in keyway. Plate 34 is provided with a series of holes 36 for receiving selectively a pin 37 which extends through a hole in eccentric disc 22 and is spring-loaded by a spring 39 which thrusts against a flange 38 on the pin. It will be seen that by withdrawing pin 39 from the plate 34, moving the disc 22 angularly, and then reinserting the drive pin 39 in a different hole 36, the angular position, and hence the phase relationship, of the center eccentric disc 22 may be adjustable relative to the two outside discs 21 and 23. Spring 39 is retained by retainer 139.

The three eccentric discs 21, 22 and 23 carry, respectively, cranks 31, 32 and 33, suitably supported on bushings 131, 132, 133. In FIG. 1, the outside eccentric discs 21 and 23 are illustrated in such position that the outside cranks 31 and 33 are at the bottom of their downward strokes. At this same instant, the center eccentric disc 22 is in the position shown in FIG. 2. As seen in FIG. 2, the center crank 32 has started its downward descent, but will not reach its downward limit for another 37°.

The two outside cranks 31 and 33 each carries at its lower end a stub-shaft, 41 and 43, respectively, suitably journalled in bushings 141 and 143. The inward ends of the stub shafts 41 and 43 project into opposing holes in the walls of a hollow rectangular ram or slide 50 which is slidable up and down within, and is guided by, the hollow rectangular lower guide portion 24 of the housing 20. Guide portion 24 is secured to the upper portion of the housing, as by bolts and dowels 25.

Referring now to FIG. 3, bolted as by bolts and dowels 52 to the lower end of the rectangular slide or ram 50, and carried thereby, is a hollow neck portion 53 the upper neck of which adapts to the rectangular opening between rams 50 and the lower portion of which is round having a central bore into which a cylindrical screw and die holder 60 is inserted.

The upper end portion of neck portion 53 has a recess 54 into which is inserted a nut 55 which is non-rotatable in the neck 53. The non-rotatable nut 55 is provided with fine threads 58 which receive the fine threaded upper end portion 61 of the die holder 60. The lower end 62 of die holder 60 has an enlarged diameter and is externally threaded at 63 with threads which are much larger than the fine threads of the upper end portion 61. An internally-threaded clamping ring 65 is screwed onto the external threads 63 and tightened against the end surface 57 of the neck 53.

The enlarged-diameter lower end portion of the die holder 60 has a recess which receives the upper end portion of a hollow cylindrical cutting-and-forming die 70. The lower end portion 71 of the cutting-and-forming die 70 is of reduced diameter forming, at the junction with the upper end portion, a shoulder 72. A lock cap 67 is fitted over the reduced-diameter portion 71 of die 70 and abuts against the shoulder 72 of the die 70. Cap 67 is secured, as by bolts 66, to the end surface of the die holder 60.

The cylindrical cutting-and-forming die 70 has cutting edges and recessed portions which function as the forming portions. The die 70 may correspond to that disclosed and illustrated in FIG. 9 of my U.S. Pat. No. 3,726,000.

Positioned below the cutting-and-forming die 70 in the base 90 of the press is a pierce-and-forming punch 80. The pierce-and-forming punch 80 has cutting edges for piercing, and recessed portions for forming. The punch 80 may correspond to the punch described in my U.S. Pat. No. 3,726,000, and may be axially adjustable as there shown. Surrounding the pierce-and-forming punch 80 is a stripper or spring member 81 which may preferably be formed of urethane material.

Positioned within the aligned bores of the die holder 60 and die 70 is the elongated shank of a flattening punch 92. As seen in FIGS. 1–3, flattening punch 92 is supported by a punch holder 292 fastened to a center ram or slide 392 which is carried by pin 42 and adjustable member 44. Adjustable member 44 is supported adjustably by a bolt 45 which in turn is supported by a plate 46 secured, as by screws 47 (FIG. 2) to the underside of center crank 32. Plate 46 has a depending portion 146 having therein a pair of slots 43 which receive screws 49. In this way, the member 44 is supported against rotation. Bolt 45 has an enlarged portion head 145 which is supported in a recess in plate 46. Bolt 45 also has an integral enlarged round portion 245 with holes for pin which may be engaged, as by a pin wrench, to turn bolt 45 to raise or lower member 44, thereby to adjust the position of the head 192 of flattening punch 92 relative to the pierce-and-forming punch 80. To make this adjustment, it is, of course, necessary to loosen the screws 49.

To adjust the position of the cutting-and-forming die 70 relative to the fixed pierce-and-forming punch 80, the operator manually unscrews clamping ring 65 and then manually grasps and moves die holder 60 in one rotational direction or the other. Since nut 55 is non-rotatable in the recess 54 in neck 53, when the die holder 60 is manually rotated, it turns on threads 58 and is therefore moved adjustably upwardly or downwardly in neck 53, according to the direction in which holder 60 is rotated. When holder 60 is so adjusted upwardly or downwardly, the cutting-and-forming die 70 is moved adjustably in corresponding manner since it is carried by the holder 60. And, since threads 58 are fine threads, fine and accurate adjustment may be made of the position of the cutting-and-forming die 70.

After the fine adjustment just described has been made, clamping ring 65 is replaced and tightened. The threads 63 of clamping ring 65 and of the lower enlarged portion 62 of the die holder 60 are large and heavy in comparison with the fine threads inner wall of the hollow cylindrical cutting-and-forming die 70 may each be provided with flats (flat surfaces). These flats are clearly seen in FIG. 4, which is a view taken along the line 4—4 of FIG. 3. The flattening punch 92 is maintained in its proper oriented position by punch holder 292 which is secured to the center ram 392.

The fixed pierce-and-forming punch 80 in the base 90 of the machine is supported in a punch holder 180 which has a flat 181. The flat on the punch 80 is oriented to correspond with the flat 181 on the punch holder 180.

Figure 5:
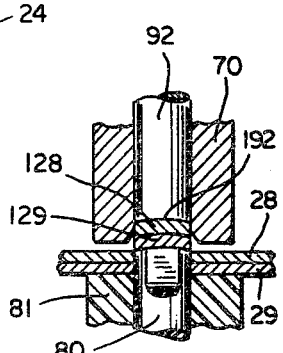
FIG. 5 is an enlarged illustration showing that the displaced minor area of the lower sheet is uncovered by the die at a time when the flattening punch has engaged the displaced minor area of the upper sheet, to compress and spread the displaced minor area of the lower sheet while the upper minor area is still confirmed.

FIG. 5 illustrates a preferred manner of operation. FIG. 5 shows two overlying sheets 28 and 29 at a time instant in the operating cycle of the fastening machine after the minor areas 128 and 129 have been displaced by the downwardly-moving cylindrical cutting-and-forming die 70 in cooperation with the fixed pierce-and-forming punch 80. In FIG. 5, the cylindrical cutting-and-forming die 70 is now rising or dwelling and flattening punch 92 is moving downwardly. The end face 192 of the downwardly-moving flattening punch 92 has just engaged the upper surface of the displaced minor area 128 of the upper sheet. At this instant, cylindrical die 70 has just cleared the displaced minor area 129 of the lower sheet. The minor area 128 of the upper sheet is still encased. This represents a desirable timing relationship. It allows the flattening punch 92 to transmit its energy through the still-encased displaced minor area 128 of the upper sheet to the displaced minor area 129 of the lower sheet to spread the lower minor area 129 over the upper sheet 28.

One means for achieving the desirable timing relationship just described between the cylindrical cutting-and-forming die 70 and the flattening punch 92 is illustrated in FIGS. 1 and 2, and has already been briefly described hereinbefore. It will be seen that the phase relationship between the flattening punch 92 and the cylindrical die 70 is adjustable by means of the phase selector drive plate 34. To adjust the phase relationship, the drive pin 37 is pulled out of the hole 36 in which it had been positioned, the freely-mounted disc 22 is rotated adjustably on the shaft 10, and the drive pin 37 is reinserted in a different hole 36 of the series of holes provided in the phase selector drive plate 34. The phase adjustment allows the desirable timing relationship described above, and illustrated in FIG. 5, to be maintained for different thicknesses of sheets.

As has already been indicated, the relationship between the pierce-and-forming punch 80 in the base of the machine and the flattening punch 92 may be adjusted for different thicknesses of sheets, and/or for wear, either by adjusting the flattening punch 92 as described in the present application or by adjusting the base punch 80 as described in my earlier-filed application. In either case, adjustment of the phase relationship between the flattening punch 92 and the cylindrical die 70, as by means such as have been described herein, is desirable in order to achieve the advantageous timing relationship illustrated in FIG. 5 and described above.

Figure 7:
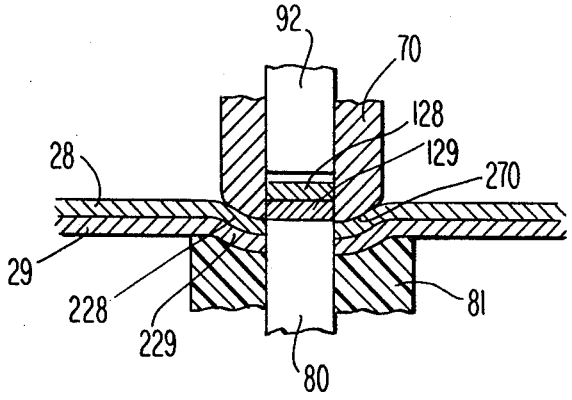
FIG. 7 is a view, in section, generally similar to FIG. 5 but showing the use of a cylindrical die shaped to bend down the edge portions of the major areas immediately adjacent the discontinuous slits defining the minor areas.

While FIG. 5 illustrates one preferred mode of operation, there may be instances in which it is necessary or desirable to reduce the extent to which the displaced minor-areas 128 and 129 project above the plane of the non-displaced major-areas of sheet 28 and 29. In such instances, the cylindrical die 70 may be provided with an end face 270 shaped as illustrated in FIG. 7 so that during the pierce-and-punch portion of the cycle, the edge portions 228 and 229 of the major-areas of sheets 28 and 29 are bent downwardly immediately adjacent the slots or piercings. The stroke of the cylindrical die 70 is so adjusted that the minor-areas 28, 29 are displaced to a position just above the bent-down edge portions 228, 229.

Figure 8:
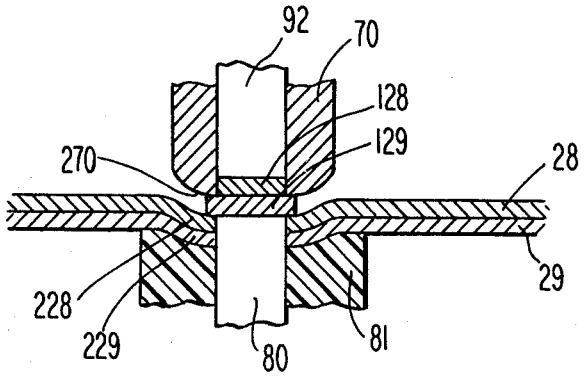
FIG. 8 is a view, in section, similar to FIG. 7 but showing the instant in the operational cycle when the cylindrical die has been raised above the displaced minor area of the lower sheet and the flattening punch has engaged the displaced minor area of the upper sheet to compress and to spread outwardly the displaced minor area of the lower sheet over the bent-down edge portions.

FIG. 8 is related to FIG. 7. FIG. 8 illustrates the instant in the operating cycle when the cylindrical die 70 has risen and just cleared the displaced minor area 129 of the lower sheet. The downwardly-moving flattening punch 92 has engaged the displaced minor-area 128 of the upper sheet which is still confined within the cylindrical die 70. The energy involved in the compressive force of flattening punch 92 on the confined upper area 128 has been transmitted to the displaced lower minor-area 129 and as a result, the displaced minor-area 129 of the lower sheet has spread outwardly over the upper surface of the bent-down edge portion 228 of the upper sheet.

It will be seen from FIG. 8 that the extent to which the displaced minor-areas extend above or beyond the plane of the non-displaced sheets 28, 29 has been reduced relative to that illustrated in FIG. 5. And as previously indicated, reducing the extent to which the displaced minor-areas extend above or beyond the planes of the sheets 28, 29 may be necessary or desirable in instances where space limitations are involved.

Figure 9:
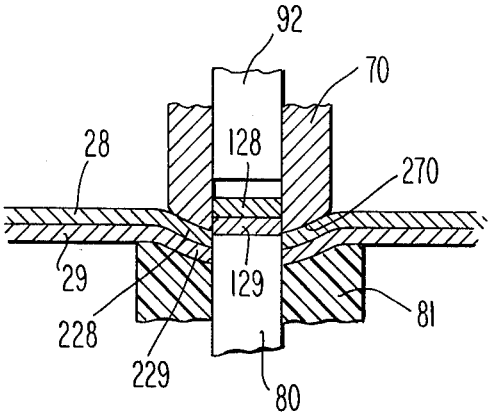
FIGS. 9 and 10 are views, in section, similar to FIGS. 7 and 8 but differ from FIGS. 7 and 8 in that the displacement of the minor areas is slightly less, such that a small portion of the lower minor areas has not fully cleared the upper major area.
Figure 10:
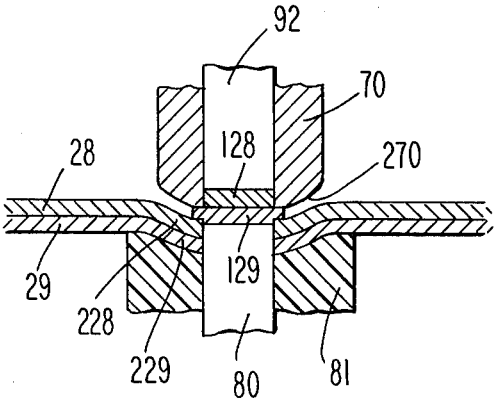

FIGS. 9 and 10 are views generally similar to FIGS. 7 and 8, respectively, but in FIG. 9 the displacement of the minor areas 128, 129 relative to the bent down portions 228, 229 of the major areas is slightly less so that the minor area 129 of the lower sheet does not fully clear the bent-down portion 228. Thus, when, as seen in FIG. 10, the minor areas 128, 129 are compressed between the punches 92 and 80 at a time when the upper minor area 128 is confined by the die 70, the lower minor area 129 is spread in the manner shown in FIG. 10. That is to say, a major portion of the lower minor area 129 is spread over the bent-down portion 228, but a minor portion of 129 remains in the opening created by the displacement. The type of joint shown in FIGS. 9 and 10 is desirable in some installations, as where it is desired to reduce or eliminate the amount of light or water which will pass through the joint.

Figure 11:
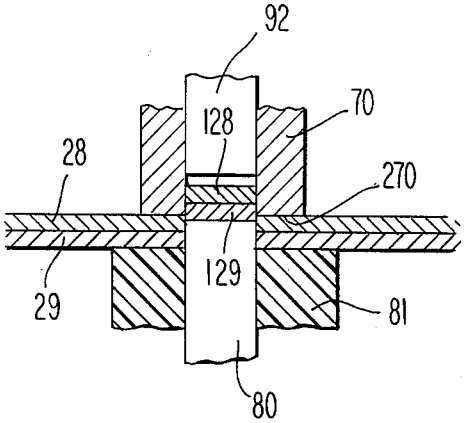
FIGS. 11 and 12 are views, in section, similar to FIGS. 9 and 10 in that a small portion of the lower minor area has not fully cleared the upper major area and is left in the slot but FIGS. 11 and 12 differ from FIGS. 9 and 10 in that the edges of the slots in the major areas are not bent down.
Figure 12:
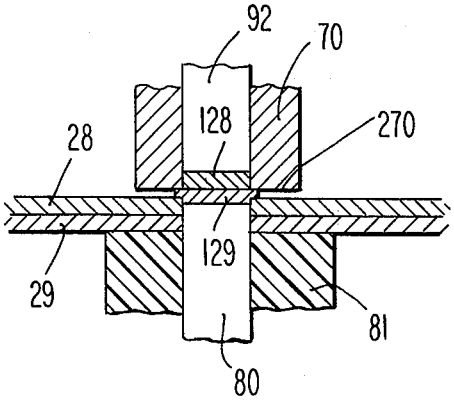

FIGS. 11 and 12 are views generally similar to FIGS. 9 and 10 showing a light-tight and water-light joint, but in FIGS. 11 and 12 the portions of the major areas 28, 29 immediately adjacent the slot are not bent down. In other respects, the joint of FIGS. 11 and 12 is similar to the joint of FIGS. 9 and 10 in that the upward displacement of the minor areas 128, 129 in FIG. 11 is such that the lower minor area 129 does not fully clear 28 so that when the minor areas 128, 129 are compressed while 128 is confined, the lower minor area 129 is spread as shown in FIG. 12, with a portion of 129 remaining in the slot formed by the piercings and displacement.

What is claimed is:

1. A method of locking together overlying sheets of metal or other material having deformable properties and including at least first and second sheets having interior and opposed exterior surfaces; said method comprising:

a. piercing said overlying sheets discontinuously along a boundary line defining a minor area;

b. displacing in one direction the material of said first and second sheets within said minor area out of the respective planes of the first and second sheet major-area sheet material to form a slot and bending in the opposite direction the edge portions of the major-area sheet material adjacent said slot, the extent of said displacement of said minor-area material being such that a substantial portion of the minor-area material of the first sheet is beyond the exterior surface of the bent edge portion of the second sheet material and a minor portion of the minor-area material of the second sheet is within said slot;

c. compressing together the displaced minor-area material of said first and second sheets while confining the displaced minor-area material of the second sheet to limit its outward spread and to spread outwardly said substantial portion of displaced minor-area material of the first sheet over the exterior surface of the bent edge portion of the second sheet material beyond said slot.

2. A method of locking together overlying sheets of metal or other material having deformable properties and including at least first and second sheets having interior and opposed exterior surfaces; said method comprising:

a. piercing said overlying sheets discontinuously along a boundary line defining a minor area;

b. displacing in one direction the material of said first and second sheets within said minor area out of the respective planes of first and second sheet major-area sheet material to form a slot, the extent of said displacement of said minor-area material being such that a substantial portion of the minor-area material of the first sheet is beyond the exterior surface of the second sheet material and a minor portion of the minor-area material of the first sheet is within said slot;

c. compressing together the displaced minor-area material of said first and second sheets while confining the displaced minor-area material of the second sheet to limit its outward spread and to spread outwardly said substantial portion of displaced minor-area material of the first sheet over the extended surface of the second sheet material beyond said slot.

3. Apparatus for locking together overlying sheets of metal or other material having deformable properties and including at least first and second sheets having interior and opposed exterior surfaces; and apparatus comprising:

a. means for piercing said overlying sheets discontinuously along a boundary line defining a minor area;

b. means for displacing in one direction the material of said first and second sheets within said minor area out of the respective planes of the first and second sheet major-area sheet material to form a slot, and for bending in the opposite direction the edge portions of the major-area sheet material adjacent said slot, the extent of said displacement of said minor-area material being such that a substantial portion of the minor-area material of the first sheet is beyond the exterior surface of the bent edge portion of the second sheet material and a minor portion of the minor area material of the first sheet is within said slot;

c. means for compressing together the displaced minor-area material of said first and second sheets while confining the displaced minor-area material of the second sheet to limit its outward spread and to spread outwardly said substantial portion of displaced minor-area material of the first sheet over the exterior surface of the bent edge portion of the second sheet material beyond the edges of said slot.

4. Apparatus for locking together overlying sheets of metal or other material having deformable properties and including at least first and second sheets having interior and opposed exterior surfaces; and apparatus comprising:

a. means for piercing said overlying sheets discontinuously along a boundary line defining a minor area;

b. means for displacing in one direction the material of said first and second sheets within said minor area out of the respective planes of the first and second sheet major-area sheet material to form a slot, the extent of said displacement of said minor-area material being such that a substantial portion of the minor-area material of the first sheet is beyond the exterior surface of the second sheet material and a minor portion of the minor area material of the first sheet is within said slot;

c. means for compressing together the displaced minor-area material of said first and second sheets while confining the displaced minor-area material of the second sheet to limit its outward spread and to spread outwardly said substantial portion of displaced minor-area material of the first sheet over the exterior surface of the second sheet material beyond the edges of said slot.

* * * * *